United States Patent [19]

Mathe et al.

[11] 4,373,769

[45] Feb. 15, 1983

[54] ELECTRICAL CONNECTOR INCLUDING INSULATION-OPENING CONTACT

[75] Inventors: Istvan Mathe; Alan H. Kasper, both of Cicero, Ill.

[73] Assignee: Allied Corporation, Morris Township, Morris County, N.J.

[21] Appl. No.: 606,121

[22] Filed: Aug. 20, 1975

[51] Int. Cl.[3] ..... H01R 13/38

[52] U.S. Cl. ..... 339/97 R

[58] Field of Search ..... 339/95, 97-99, 339/223

[56] References Cited

U.S. PATENT DOCUMENTS

| | | | |
|---|---|---|---|
| 3,162,501 | 12/1964 | Wahl | 339/98 |
| 3,657,682 | 4/1972 | Inversen | 330/97 R |
| 3,717,841 | 2/1973 | Mancini | 339/252 P |
| 3,867,005 | 2/1975 | Hoppe, Jr. | 339/98 |
| 3,883,212 | 5/1975 | Keglewitsch | 339/276 A |
| 3,895,852 | 7/1975 | Masserlein, Jr. | 339/99 R |
| 3,902,154 | 8/1975 | McKee | 339/223 R |
| 3,926,498 | 12/1975 | Hoppe, Jr. | 339/97 R |

FOREIGN PATENT DOCUMENTS

| | | | |
|---|---|---|---|
| 7212035 | 6/1972 | Fed. Rep. of Germany | 339/97 R |
| 377374 | 2/1965 | France | 339/97 P |
| 67298 | 9/1950 | Netherlands | 339/97 R |

OTHER PUBLICATIONS

Lueger Lexikon Der Technik.
Merkblatt 350.

*Primary Examiner*—Joseph H. McGlynn

[57] ABSTRACT

An electrical connector is provided with a plurality of contacts, each of the contacts having an insulation-opening terminal element of sheet metal construction to electrically contact an insulated conductor. The contact is advantageously constructed for receiving an insulated stranded conductor, but is equally applicable for receiving an insulated solid conductor. Each contact includes an active portion, of either male or female configuration, a terminal element portion, and an intermediate portion connecting the active and terminal element portions. The terminal element portion preferably includes an elongate open channel of U-shaped cross-sectional configuration having side and bottom walls, the sidewalls including opposite portions dimpled in to provide inner detents forming, and separated by, a conductor-receiving notch for opening the insulation of the conductor and electrically engaging the underlying exposed conductor. A plurality of different embodiments of a detent are offered, each of which advantageously includes an enlarged wiping surface, a notch entrance and a smooth portion adjacent the notch entrance to prevent snagging, and possibly severing, of the individual strands of a stranded conductor.

52 Claims, 17 Drawing Figures

ELECTRICAL CONNECTOR INCLUDING INSULATION-OPENING CONTACT

BACKGROUND OF THE INVENTION

1. Field of the Invention

This invention relates to electrical connector of the insulation-piercing type, and more particularly to electrical connectors having contacts which are constructed to receive and electrically contact insulated stranded conductors, as well as insulated solid conductors.

2. Description of the Prior Art

Electrical connectors having insulation-piercing contacts are well known in the art. For example, one may refer to U.S. Pat. Nos. 3,867,005, issued Feb. 18, 1975 to Paul Peter Hoppe, Jr., and assigned to Bunker Ramo Corporation, and to the parent application, Ser. No. 288,988, filed Sept. 14, 1972 concerning electrical connectors and insulation-piercing contacts. Yopp Pat. No. 3,002,176 also discloses this general type of electrical connector, however, without insulation-piercing contacts.

Heretofore, electrical connectors have utilized such techniques as crimping and soldering to connect both solid and stranded conductors to the contacts of an electrical connector.

As set forth in the aforementioned patents, the usual technique for connecting circuit elements, such as the mentioned conductors, to the contacts of the connector, has been to strip the insulation from the end of the conductor and to solder the conductor to a contact. This is a very time consuming operation and the procedure requires considerable skill, particularly where miniaturized connectors are concerned. When using soldering techniques, there is also the possibility of undesirable bridging connections occuring between adjacent contacts of the connector due to the tendency of solder to follow a heated path upon withdrawal of a soldering implement.

As also set forth in the aforementioned patents, an alternative technique which has gained increasing acceptance in the art is the utilization of insulation-piercing terminal elements as a portion of the contacts. Such terminal elements sever or cut through the insulation and establish an electrical connection to the conductor without stripping and without soldering. Insulation-piercing terminal elements usually involve the utilization of a forked structure having cutting edges that sever and penetrate the insulation, and serve as wiping surfaces in some configurations, to make the necessary electrical, and for that matter mechanical, connection with the conductor. The insulation-piercing terminal therefore serves to sever the insulation of the conductor and to act both as a mechanical and electrical connection for the contact and the conductor.

The aforementioned art, which is fully incorporated herein by this reference, is fully acceptable and completely satisfactory for electrically contacting insulated conductors, particularly the solid insulated conductors. When dealing with stranded conductors, however, particularly stranded conductors in the range of 24–28 gauge, oftentimes the strands snag upon, and even become severed by, the edges which are provided for piercing the insulation of an insulated conductor. When using stranded conductors, undesirable problems can therefore arise due to snagging and/or severing of the individual strands including incomplete and sometimes noisy connections which are intolerable.

SUMMARY OF THE INVENTION

The primary object of the invention, therefore, is to provide an electrical connector having insulation-opening contacts which overcome the aforementioned problems concerning snagging and/or severing of the individual strands of an insulated stranded conductor.

Another object of the invention is to provide an insulation-piercing or -opening contact for an electrical connector, which contact is suitable for terminating both insulated stranded and insulated solid conductors.

Another object of the invention is to provide an electrical contact for an electrical connector in which the termination element includes conductor retention means for ensuring that a conductor remains seated in a desired position once the conductor has been inserted to that position.

A further object is to substitute smooth guide surfaces for at least part of the tapered cutting edges to reduce snagging and/or severing of the strands of an insulated stranded conductor.

Still another object is to form the smooth guide surfaces from the smooth flat uncut side of sheet metal.

An additional object is to provide side and bottom support for insulation-piercing detents so that the detents exhibit sufficient strength to penetrate or move the insulation to expose the underlying conductive strands while providing a smooth surface to guide the strands to a lower wiping surface.

Inasmuch as it is desirable in the production of contacts of an electrical connector to provide an electrical connector which is mechanically stable over a long period of time, and as a high tensile strength sheet metal has found to be suitable for contact use over an extended period, and as certain production problems concerning the bending of high tensile strength sheet metal material arise when resiliency over a short length is concerned, particularly with respect to double and reverse bends at the active portion of a contact to provide both male and female configurations, another object of the invention is to provide an insulation-opening contact structure having an active portion connected thereto by a stable configuration which avoids sharp reverse bends and which utilizes a material having sufficient resiliency to serve for a great number of engagement and disengagement operations over an extended period of time.

A primary feature of the invention resides in the provision of an insulation-opening notch, preferably in a U-shaped channel, for opening the insulation and contacting a conductor with a wiping action. The notch includes an enlarged conductor wiping surface, a smooth lead-in surface, and a portion which defines a change of direction between the lead-in surface and the wiping surface. Advantageously, the notch may be formed by press-forming a pair of inwardly directed detents which carry the above mentioned surfaces, although a variety of other structures and techniques may be utilized depending on different construction and application requirements.

BRIEF DESCRIPTION OF THE DRAWINGS

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1:
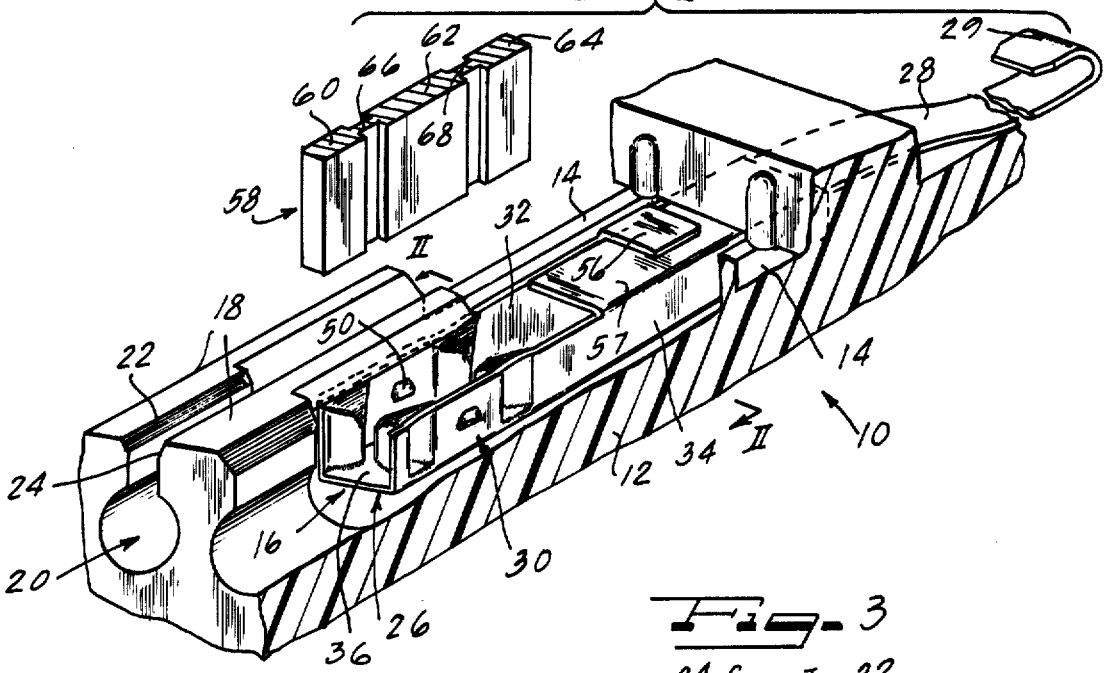
FIG. 1 is a fragmentary perspective view of an electrical connector constructed in accordance with the present invention.
Figure 3:
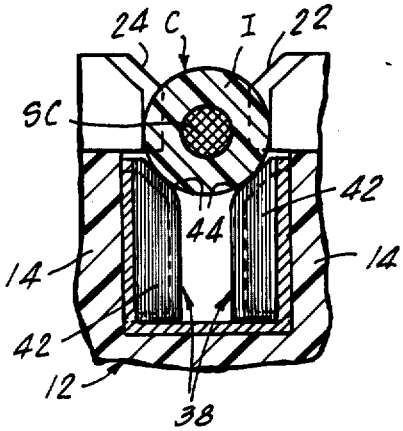
FIGS. 3, 4 and 5 are sectional views taken substantially along the line II—II of FIG. 1 illustrating an insulated stranded conductor at different positions during the insertion process.

At the outset, one will appreciate that the apparatus illustrated in FIG. 1, with the exception of the inventive features disclosed herein, is substantially the same configuration of FIG. 3 of the aforementioned U.S. Pat. No. 3,867,005. It is readily apparent from FIG. 3 of that patent, and from the instant FIG. 1, that the general construction of an electrical connector unit according to the present invention, is generally the same as disclosed in FIGS. 1, 2 and 3 of U.S. Pat. No. 3,867,005. It is therefore readily apparent that the plurality of conductors and contacts of an electrical connector according to the Hoppe patent is also envisioned for an electrical connector which includes the features of the present invention.

Figure 2:
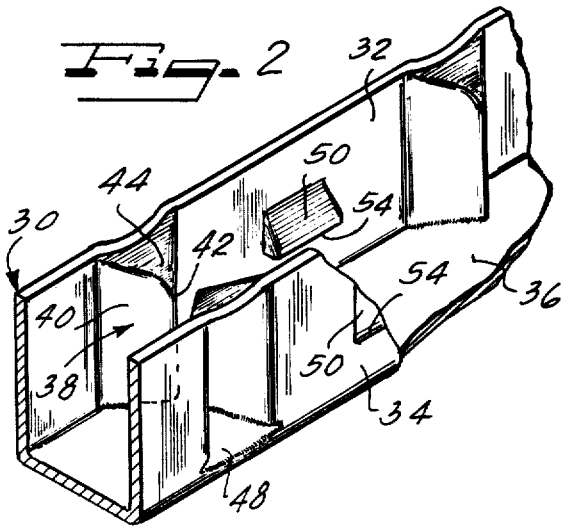
FIG. 2 is an enlarged perspective view of a portion of a contact termination element constructed in accordance with the invention.

Referring to FIGS. 1 and 2, the basic construction of an electrical connector is illustrated at 10 as comprising a dielectric contact mount 12 which is illustrated in the form of a plug unit which is adapted for connection to a mating complementary receptacle unit (not shown). The plug unit comprises the contact mount 12 which is constructed of molded dielectric material, such as "DAP" Nylon, or Polyester and is designed to have a plurality of spaced barriers 14 which define a plurality of contact mounting passages 16. Each of the barriers 14 includes an extended portion 18 which defines strain relief passages 20. Each of the strain relief passages 20 includes an entrance defined by a pair of oblique surfaces 22 and 24.

Each of the contact passages 16 includes a contact 26 mounted therein. Each of the contacts 26 includes an active contact element 28, here illustrated as having a hook-shaped reentrant portion 29 as in the aforementioned U.S. Pat. No. 3,867,005. The active portion could, however, have any desirable shape. The contact 26 also includes a termination contact element 30 and an intermediate contact element or portion connecting the active and termination elements, the intermediate portion to be described in detail below.

Each termination element comprises a pair of generally parallel sidewalls 32 and 34 which extend generally perpendicular to a bottom wall 36 to form an open U-shaped configuration.

In the termination contact element 30 illustrated in FIGS. 1 and 2, the sidewalls 32 and 34 have been dimpled to provide inwardly directed detents 38 which define a channel constriction or notch in which the constriction elements are in an interference relationship with an insulated conductor to be received in the channel. Although the notch is illustrated as comprising a pair of opposed inwardly directed detents facing each other, the constriction may also comprise a pair of inwardly directed detents which are offset longitudinally with respect to each other along the termination contact element.

Each of the detents 38 includes a pair of inwardly directed portions 40 which respectively join the respective sidewall and which join together in an enlarged surface 42 which constitutes a wiping surface for an exposed conductor, whether the conductor is solid or stranded. Each detent 38 also comprises a surface 44 which is continuous with the portions 40 and 42 back to the outer edge of the respective sidewall. The surface 44 is particularly characterized as a smooth surface, at least in the area immediately adjacent the wiping surface 42 and is further characterized as developing into the wiping surface 42 with a gradual change of direction.

In the construction illustrated in FIG. 2, at least one of a plurality of channel walls 32, 34 and 36 afford support against insertion forces for the detent. As illustrated, surface 44 is supported against insertion forces in the direction of insertion by first support means represented by bottom wall 36 integrally connected to detent wall 40. Side wall 32 integrally connected to detent wall 40 provides a second support means for wiping surface 42 against insertion forces in a direction transverse to the direction of insertion.

Figure 4:
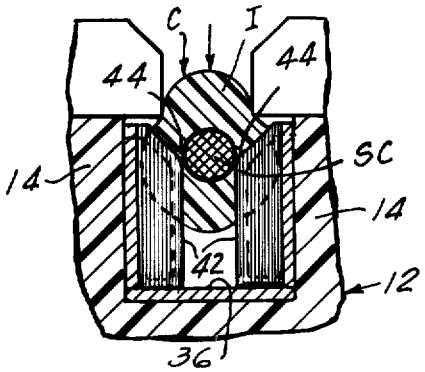
Figure 5:
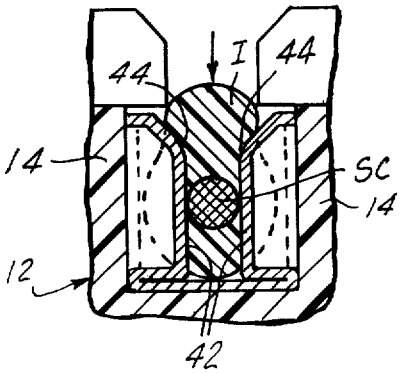

As illustrated in FIGS. 3-5, as an insulated conductor C is forced into the channel, and thus into at least one notch defined by a pair of detents, the insulation I is opened to expose the conductor SC so that the same is subjected to a wiping contacting of the surfaces 42. As the insulation is forced open as it passes the smooth and gradual change of direction surfaces, as opposed to an actual cutting type severing, the individual strands, if a stranded conductor is employed, are exposed to the change of direction defined by the surfaces, but the strands are not subjected to snagging and/or severing as would be the case with contact elements heretofore employed.

Referring again to FIG. 2, as a conductor is forced downwardly into a termination contact element to a desired position, the conductor passes another detent type element 50 which is embossed and lanced to include an underlying edge 54 which engages the insulation to retain the conductor within the channel.

A number of insertion tools may be employed in terminating electrical conductors in the termination contact elements constructed in accordance with the present invention, such as the tool described by Istvan Mathe in his U.S. patent application Ser. No. 360,037, filed June 14, 1973 and assigned to Bunker Ramo Corporation. Another tool which is suitable for utilization with the present invention is illustrated, in part, in FIG. 1 as comprising an insertion blade 58 having a plurity of insertion portions 60, 62 and 64 which are to be positioned against a conductor at respective locations on each side of an insulation notch. The blade 58 includes narrow portions 66 and 68 which may be formed by opposed grooves on the sides of the insertion tool which are aligned with the notches formed by the detents 38. In addition, the blade 58 may comprise an additional portion (not shown) for pressing the conductor into the strain relief generally defined by the passageway 20.

Because of the desirability to use high tensile strength materials, and inasmuch as such materials involve difficulties in forming reverse bends and the like, and as it is highly desirable to use such materials for extended contact life, the present invention utilizes a unique contact structure which is adaptable for high tensile strength materials and mounting of the contacts within a contact mount. This structure comprises a flap or extension of a portion of the sidewall 34 which is bent at 90° with respect thereto toward the sidewall 32 and a tab 56 on the sidewall 32 which is bent in the opposite direction to overlie and lock the member 57. This forms a stable box-shaped structure at the end of the termination contact element which is received in a complementary box-shaped portion of the passage 16 in the connector mount 12. The member 57 carries the active contact element 28 as a forwardly directed (in the sense of connector directions) portions thereof.

In some manufacturing processes, and in the case of different applications, it may be more advisable and advantageous to form the notch defining structures by different processes than the aforementioned detenting process by press-forming the side-walls of the termination contact element, or by press-forming the detents in a different configuration. Inasmuch as each of the detents is, in effect, an internal wall within the channel, the detents are also hereinafter referred to as inner walls which may have individual wall portions or wall sections.

Figure 6:
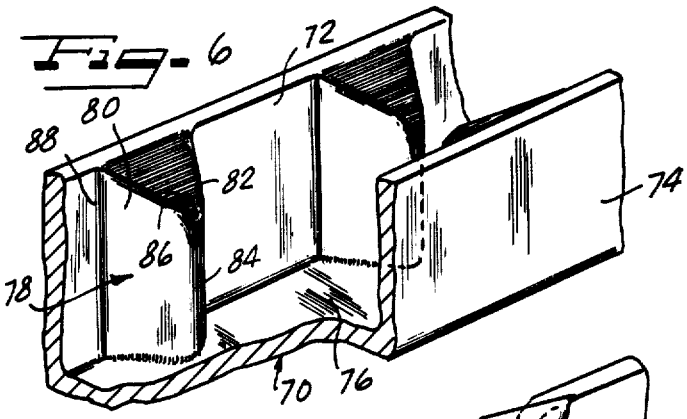
FIG. 6 is a fragmentary sectional and isometric view of another embodiment of a termination element constructed in accordance with the present invention.

Referring to FIG. 6, for example, the same general shape for a detent is illustrated as is shown in FIGS. 1 and 2. In FIG. 6, however, each of the detents 78 comprises a pair of inwardly directed walls 80 and 82 which converge in a rounded surface 84 and which are joined by an oblique surface 86 having a smooth portion adjacent the surface 84. The walls and surfaces 80-86 are formed in a separate process as a cup-shaped structure which is welded around the periphery, as at 88, to the respective sidewall 72 which extends from a bottom wall 76 parallel to a complementary sidewall 74 of a termination contact element 70.

Figure 7:
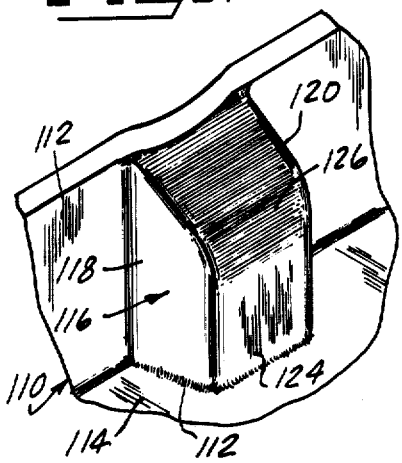
FIG. 7 is a fragmentary perspective view of another embodiment of a termination element constructed in accordance with the invention.

Referring to FIG. 7, a termination contact element 110 is briefly illustrated as comprising a sidewall 112 (the other sidewall not being shown) which extends generally normal to a bottom wall 114. An inner wall 116 is illustrated as comprising a pair of inwardly directed walls 118 and 120 having a bottom edge 122 above the bottom wall 114 and which are connected by a generally wide wiping surface wall 124. An additional wall 126, characterized by smooth portion adjacent the surface 124, joins the walls 118, 120 and 124 with the free edge of the sidewall 112.

Figure 8:
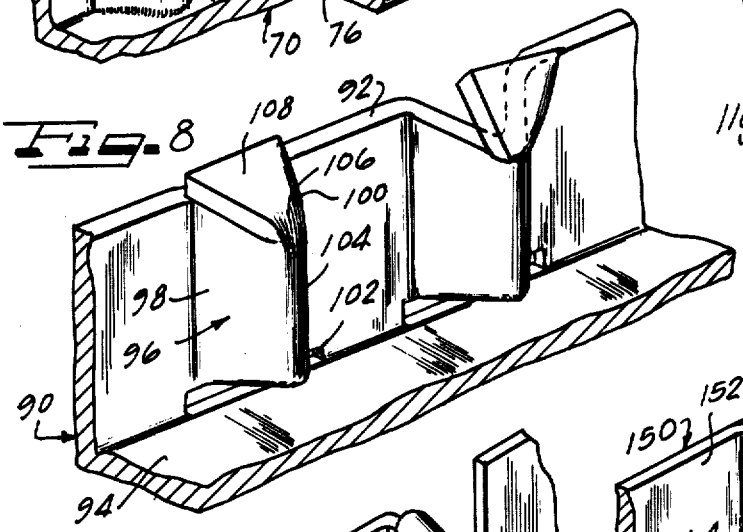
FIG. 8 is a fragmentary sectional perspective view of still another embodiment of a termination element constructed in accordance with the invention.

Referring to FIG. 8, a termination contact element 90 is illustrated as having an inner wall 96, formed as a detent, including a pair of inwardly directed walls 98 and 100 extending from the sidewall 92 which, in turn, projects from a bottom wall 94. The contact element 90 may also include another sidewall as in FIGS. 1-6.

A smooth slanted surface 106 adjacent the surface 104 is carried by a member 108 of thin conductive sheet metal which is connected to and bent at an angle with respect to the surface 104 with its smooth major surface extending as a cover and guide over walls 98 and 100. An aperture 102 has been provided at the junction of the sidewall 92 and the bottom wall 94 to facilitate forming of the detent by a pressing process so that lancing or an abrupt swedging is not necessary at that point.

Figure 9:
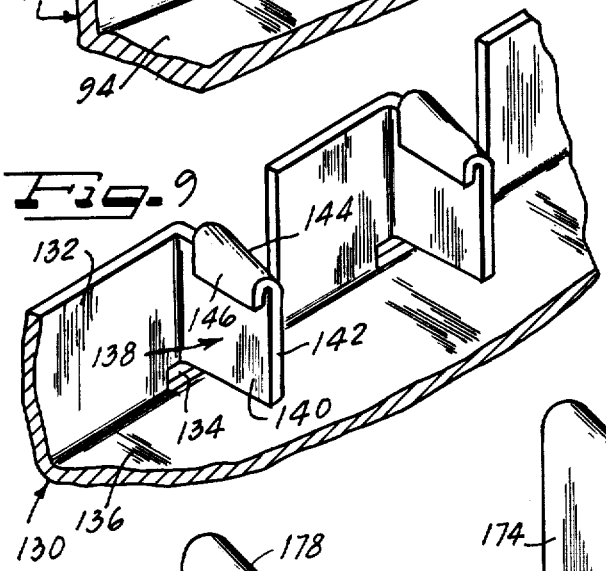
FIG. 9 is a fragmentary sectional perspective view of still another embodiment of a termination element constructed in accordance with the invention.

Referring to FIG. 9, another illustrative embodiment of a termination contact element is shown at 130 as comprising at least one sidewall 132 which projects from a bottom wall 136. Of course, a similar sidewall may extend from the bottom wall 136 in complementary opposition to the sidewall 132. The channel of the termination contact element includes an inner wall 138 which is formed out of and bent substantially 90° from the sidewall 132, the bending being facilitated by an aperture 134 at the junction of the sidewall 132 and the bottom wall 136. The inner wall 138 comprises a sidewall portion 140 having an edge 142, substantially the thickness of the sidewall 132 which forms the wiping surface for the conductor. The sidewall portion 140 includes an extended portion 146 which is folded over in a smooth inwardly and downwardly directed fold 144 to define the smooth entrance of the notch, the junction of the edge surface 142 and the rounded surface 144 defining the change of direction mentioned in respect of the above embodiments.

Figure 10:
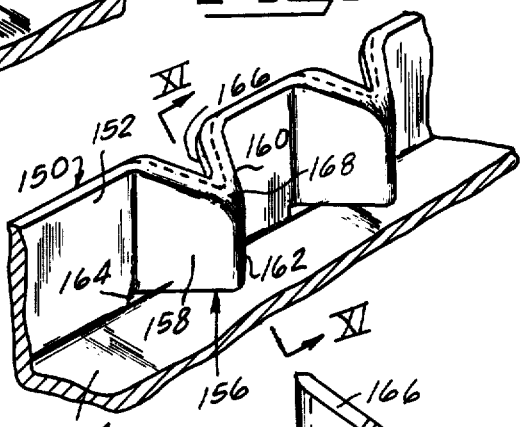
FIG. 10 is a fragmentary sectional perspective view of yet another embodiment of a termination element constructed in accordance with the invention.
Figure 11:
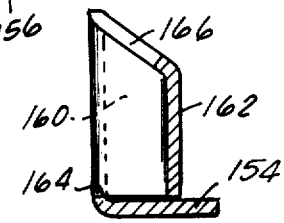
FIG. 11 is a sectional view taken substantially along the line XI—XI of FIG. 10.

Referring to FIGS. 10 and 11, a termination contact element 150 is illustrated as comprising a sidewall 152 which extends from a bottom wall 154. Again, a complementary opposed sidewall may be provided. The sidewall 152 has been relieved by an aperture at 164 to facilitate the forming of a dimple in the production of an inner wall 156 which includes a pair of convergently inwardly directed surfaces 158 and 160 which are joined at a rounded surface 162 which constitutes the conductor wiping surface. In this embodiment of the invention the press forming of the inner wall occurs more closely adjacent the free edge of the sidewall 152 than in the case of the inner wall 78 formed in the sidewall 72 in FIG. 6 so that the upper edge 166 of th sidewall 152 is turned outwardly and forms a V-shaped notch. The space between the V-shaped notch and the junction of the surfaces 158, 160 and 162 therewith constitutes a smooth surface 168 for guiding the conductor into the notch and preventing snagging of the individual strands of a stranded conductor as the notch effects opening of the insulation. The edges of the V may be coined if necessary, to prevent snagging.

Figure 12:
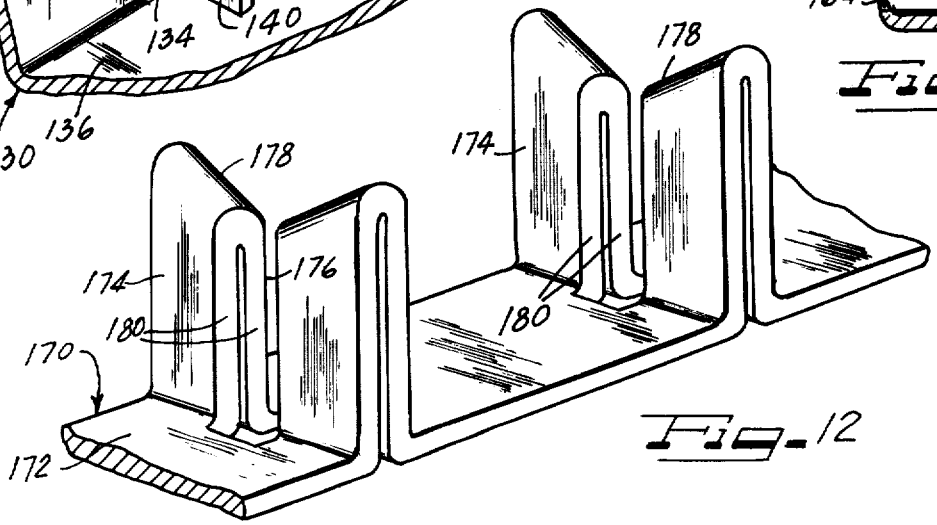
FIG. 12 is a perspective view of another embodiment of a termination element of an electrical contact constructed in accordance with the principles of the present invention.

Referring to FIG. 12, a "channel" without sidewalls is illustrated, although it is readily apparent that sidewalls could be provided. In FIG. 12, a flat piece of sheet metal is folded three times to form each notch. A "channel" comprises a bottom wall 172 having a pair of notch-defining projections extending therefrom, due to the folding process. Each of these projections comprises a pair of coextensive wall sections 174 and 176 which are joined by a rounded, smooth and inwardly obliquely directed surface 178. The bottom wall 172 has an aperture therethrough having sidewalls 180 which form the wiping surface or surfaces for the exposed conductor.

Figure 13:
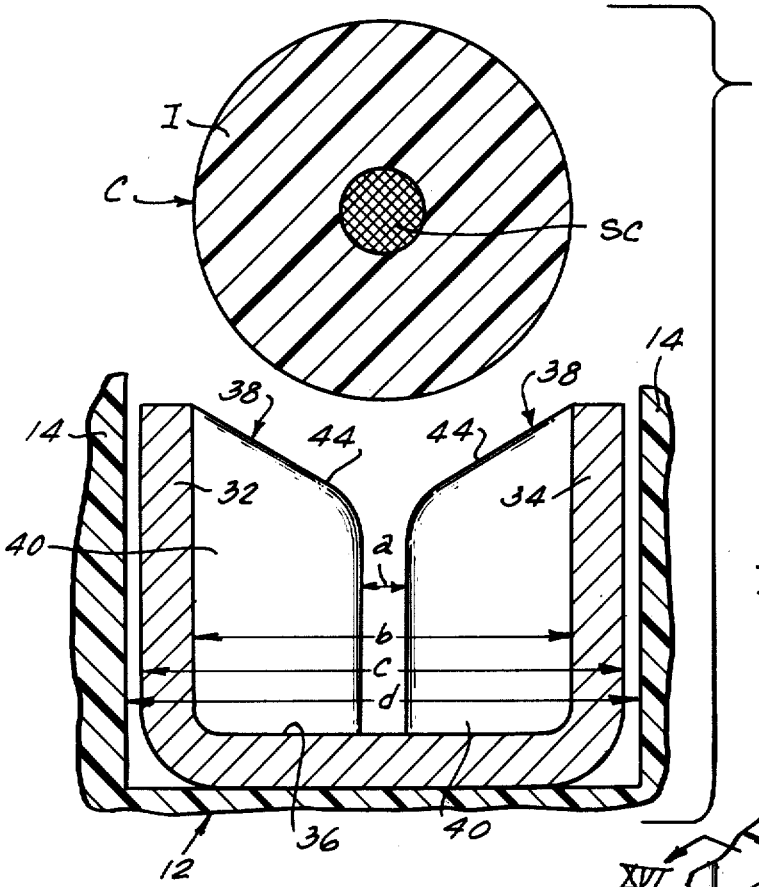
FIG. 13 is an enlarged sectional view of a contact terminal element supported between barrier walls of a connector shown before conductor insertion.
Figure 14:
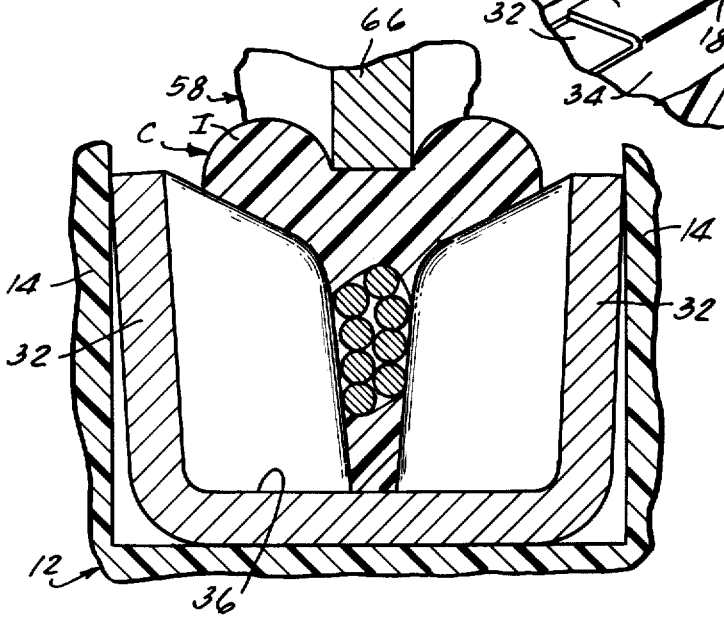
FIG. 14 is an enlarged sectional view similar to FIG. 13, illustrating the terminal element and conductor after insertion.

Referring to FIGS. 13 and 14, a more detailed showing of the relationships between the terminal element and the conductor insulation and core are illustrated. As an example, the following values are provided for a clearer understanding of the invention.

| | |
|---|---|
| Diameter | 0.045 / 0.038 |
| Diameter SC | 0.020 / 0.015 |
| Notch Width a | 0.009 / 0.005 |
| Channel Inside Width b | 0.038 |
| Channel Outside Width c | 0.051 / 0.049 |
| Barrier-Barrier Distance d | 0.054 / 0.052 |

From the dimensions given above, it is apparent that although the insulation is approximately the same diameter as the inside of the channel, the conductor diameter is much larger than the width of the notch. Therefore, as the insulated conductor is pressed into the channel, even assuming that the conductor is centered, a stranded core undergoes a cross-sectional distortion due to displacement of the individual strands during insertion. This is illustrated in FIG. 14. Also, as pressure is applied to the insulation by an insertion tool, the insulation undergoes distortion and is moved axially of the core and outwardly of the channel. It is difficult to tell exactly where any individual strand may initially contact the surface 44 which leads into the notch. Therefore, a smooth surface 44 with a gradual change of direction to the wiping surface is preferred to prevent snagging of the individual strands. With larger strands and solid conductors the change of direction can be more abrupt in that the possibility of snagging decreases with increasing conductor diameter.

Referring again to the dimensions given above, it is readily apparent that any transverse deflection of the sidewalls 32 and 34 is at a minimum because of the difference between the outside channel dimension and the distance between the barriers, for example, 0.003 inches. The terminal element is therefore well supported and does not open up to any extent to receive the conductor, thus insuring good mechanical connection and good wiping electrical connection.

Figure 16:
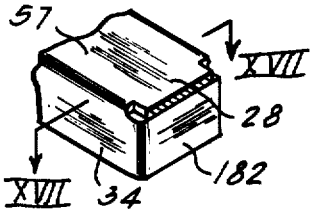
FIG. 16 is a sectional perspective view illustrating a folded end of the intermediate element as viewed in the direction XVI—XVI in FIG. 15.
Figure 15:
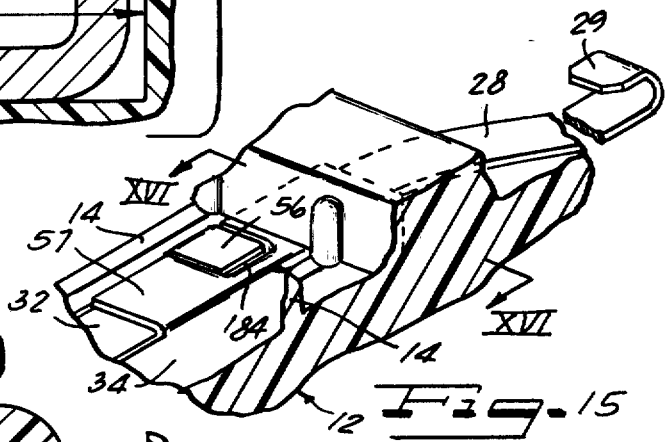
FIG. 15 is a fragmentary perspective view of the intermediate and active elements showing the folded construction in greater detail.
Figure 17:
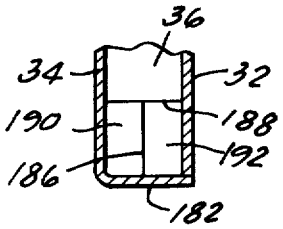
FIG. 17 is a sectional view taken along the line XVII—XVII of FIG. 16 illustrating the provision of support legs.

Referring to FIGS. 15–17, additional details of the box-shaped structure of the intermediate element are illustrated. It should be noted that the member 57 includes an embossed detent 184 for receiving the tab 56 such that the outer surfaces of the member 57 and the tab 56 are co-planer, which facilitates insertion of the terminal ends of the contacts into the dielectric support 12.

One of the sidewalls, the wall 34 in FIG. 16, also carries a member which is folded at 90° toward the opposite sidewall as another feature of the box-like structure.

It is sometimes necessary to provide supporting feet for the intermediate element of a contact. Referring to FIG. 17, the bottom wall 36 of the channel may be cut, such as at 186 and 188 to provide a pair of bottom wall sections 190 and 192 which may be folded downwardly to provide supporting feet.

In summary, therefore, we have disclosed an insulation-piercing or -opening contact for use in an electrical connector for connection to an insulated conductor, in particular an insulated stranded conductor. The contact, in some embodiments, includes an open channel for receiving the insulated conductor normal to its axis, the channel including a bottom wall and a pair of spaced sidewalls extending generally parallel to each other from the bottom wall. The channel includes at least one pair of interior walls, which may be constructed of press-formed detents, and which extend inwardly of the channel from respective sidewalls. Each of the interior walls comprises an oblique surface directed away from the respective sidewall and toward the bottom wall, a conductor wiping surface extending generally in the direction of conductor insertion, and an insulation opening portion joining the oblique and wiping surfaces and defining a change of direction between such surfaces. A smooth portion is provided on the oblique surface immediately adjacent the insulation opening portion advantageously prevents snagging when stranded type conductors are being terminated. For larger strands, a more abrupt change of direction may be employed; however, a smooth, gradual change is preferred for conductors in the area of 24–28 gauge.

Stated another way, the invention is a specific improvement for electrically terminating an insulated stranded conductor, as well as an insulated solid conductor, in an insulated piercing contact of the type in which an insulated conductor is pressed normal to its axis into an insulated-piercing notch which has an entrance and a conductor wiping surface extending transversely of the axis of the conductor. The improvement more specifically comprises a smooth surface immediately adjacent the entrance of the notch and extending oblique to the notch and a junction at the notch entrance between the smooth surface and the wiping surface of the notch which defines a change of direction between the wiping surface and the notch entrance, so that, in the case of stranded conductors, exposed strands are not subjected to snagging and/or severing by sharp projections or a sharp edge along the guide and insulation-opening paths.

Also, according to the invention, an insulation-piercing or -opening contact for an electrical connector has been disclosed as comprising a channel for receiving the insulated conductor in a direction normal to its longitudinal axis, and notch means in the channel defining a constriction having an interference relationship with the insulation of the insulated conductor. The notch means defines conductor guiding, insulation opening and conductor wiping zones and includes a conductor wiping surface which extends generally in the direction of conductor insertion, a conductor guiding surface extending oblique to the wiping surface, and an insulation opening portion connecting and defining a change of direction between the guiding and wiping surfaces, the guiding surface including a smooth zone immediately adjacent the insulation opening portion which advantageously serves to prevent snagging of the individual strands of an insulated stranded conductor.

According to the invention, an electrical connector unit has also been disclosed which utilizes a plurality of contact members mounted in individual contact mounting passages of a contact mount of dielectric material. Each of the contact members may advantageously be formed from high tensile strength sheet metal and comprises an active contact element, a terminal contact element and an intermediate contact element connecting the active and terminal contact elements. The terminal element is in the shape of an elongate U-shaped channel with a box-like structure at its junction with the intermediate contact element, the intermediate contact element carrying the active contact element.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. An insulation-piercing contact for electrical connection to an insulated conductor, comprising:

a sheet metal structure including first and second surfaces and forming an open channel for receiving an insulated conductor normal to its axis, said channel including a bottom wall and a pair of spaced sidewalls extending generally parallel to each other from said bottom wall; and at least one pair of interior walls extending inwardly of said channel from respective ones of said sidwalls;

each of said interior walls comprising an oblique portion of one of said surfaces directed away from the respective sidewall and toward said bottom wall, a conductor wiping portion of said one surface extending generally in the direction of conductor insertion, an insulation opening portion of said one surface joining said oblique and wiping surface and defining a smoothly rounded blunt nose providing a direction change therebetween, and a smooth portion on said oblique surface immediately adjacent said insulation opening portion.

2. The contact of claim 1, comprising conductor retention means including at least one projection extending from a respective sidewall, said projection defining a restriction in said channel and including an underlying ledge to engage the insulation and retain the conductor after the same has been inserted past said ledge.

3. The contact of claim 1, wherein each of said interior walls comprises a first and second surface portions extending inwardly of said channel from a respective sidewall, a third surface portion joining said first and second surface portions and defining said wiping surface.

4. The contact of claim 3, wherein each of said interior walls further includes a fourth surface portion extending at an angle to join said first, second and third surface portions and defining said oblique surface.

5. The contact of claim 3, wherein said first and second surface portions extend parallel to each other.

6. The contact of claim 3, wherein said first and second surface portions extend convergently toward each other.

7. The contact of claim 3, wherein said first, second and third surface portions outline a wall structure which is welded to the respective channel sidewall.

8. The contact of claim 3, wherein each of said interior walls comprises a fourth surface portion connected to said first, second and third surface portions and defining said oblique surface, said fourth surface portion being a deformed portion of the respective sidewall and including a V-shaped edge spaced from said third surface portion, and said smooth portion located in the space between the V-shaped edge and said third surface portion.

9. The contact of claim 3, comprising a fourth surface portion extending between said first, second, and third surface portion, said fourth surface portion including said smooth portion and continuous with and oblique to said third surface portion.

10. The contact of claim 9, wherein said first, second and third surface portions comprise deformed portions of the respective sidewall, and comprising a sidewall extension carrying said fourth surface portion.

11. An insulation-piercing contact for electrical connection to an insulated stranded conductor, comprising:

a sheet metal structure including first and second surfaces and including a channel for receiving the insulated conductor as the same is inserted in a direction normal to its longitudinal axis, said channel including at least one wall;

one of said surfaces including a conductor wiping surface portion on said one wall and extending generally parallel to the direction of conductor insertion;

a conductor guide surface portion oblique to said conductor wiping surface portion for directing the insulated conductor toward said wiping surface portion;

and an insulation opening surface portion comprising a smoothly rounded blunt nose connecting and defining a change of direction between said guide and wiping surface portions;

said guide surface portion including a smooth surface portion immediately adjacent said insulation opening surface portion to prevent snagging of the conductor strands as the insulated conductor travels from said guide surface portion to said wiping surface portion.

12. An insulation-piercing contact for electrical connection to an insulated conductor, comprising:

a sheet metal structure including first and second surfaces and defining a channel for receiving the insulated conductor in a direction normal to the longitudinal axis of the conductor; and notch means in said channel defining a constriction having an interference relationship with the insulation of the insulated conductor, said notch means defining conductor guiding, insulation opening and conductor wiping zones and including a conductor wiping surface portion on one of said surfaces extending generally in the direction of conductor insertion, a conductor guiding surface portion on said one surface extending oblique to said wiping surface portion, and an insulation opening surface portion comprising a smoothly rounded blunt nose connecting and defining a change of direction between said guiding and wiping surface portions, said guiding surface portion including a smooth surface zone immediately adjacent said insulation opening surface portion.

13. The contact of claim 12, wherein said channel comprises a pair of spaced sidewalls carrying said surfaces and said notch means comprises at least one pair of inwardly directed dimples extending from respective ones of said sidewalls and carrying said surface portions.

14. The contact of claim 13, wherein said channel comprises a bottom wall connecting said sidewalls, and said contact further comprises an active portion for engagement with a mating contact, and an intermediate portion extending from one of said sidewalls toward the other to form a box-like structure, said active portion extending from said intermediate portion.

15. The contact of claim 14, comprising a tab extending from the other sidewall toward said one sidewall to overlie said intermediate portion.

16. In a thin sheet metal insulation-piercing contact of the type in which an insulated conductor is pressed normal to its axis into an insulation-piercing notch which has an entrance and a conductor wiping surface extending transversely of the axis of the conductor, the improvement, for electrically terminating an insulated stranded conductor, comprising:

a smooth surface portion immediately adjacent and above the entrance of the notch, said smooth surface portion extending oblique to the direction of insertion into the notch, and a junction surface portion at the notch entrance between said smooth surface portion and the wiping surface of the notch comprising a smoothly rounded blunt transitional configuration defining a change of direction therebetween.

17. An electrical connector unit for use in interconnecting a plurality of electrical circuits including insulation covered conductors, comprising:

a contact mount of dielectric material having a plurality of contact-mounting passages with outer ends each being of elongate U-shaped configuration; and a plurality of contact members each constructed of thin sheet metal having first and second surfaces and mounted in said contact passages of said contact mount, each contact member including an active contact element and a terminal element disposed within the outer end of the respective contact passage, each terminal element comprising an elongate U-shaped channel including opposite sidewalls having opposite facing portions dimpled inwardly to provide at least one pair of inner detents having a space therebetween constituting a conductor receiving notch, said space between said detents being less than the distance between said sidewalls, and said detents effective to open the insulation of a conductor pressed therebetween, each of said detents comprising a pair of wall sections, each of said wall sections having one end integrally joined to the respective sidewall, the other ends of said sections joined together by a surface portion of one of said first and second surfaces at said notch to provide an enlarged wiping surface portion on said one surface for wiping contact with said conductor, and an additional wall section joined to said pair of wall sections at least in the area of said enlarged wiping surface portion and extending toward the respective sidewall, said additional wall section including a smooth surface portion adjacent said enlarged wiping surface portion and a smoothly rounded blunt transitional surface portion leading to said wiping surface portion, all of said surface portions being portions of said one surface.

18. An electrical connector unit according to claim 17, comprising:

an intermediate contact element connecting said active element and said terminal element, said intermediate element comprising a member carrying said active element and extending from one of said sidewalls toward the other to form a box-shaped end to said elongate U-shaped channel, and wherein each of said contact passages includes a complementary box-shaped section to receive said box-shaped end of said intermediate contact element.

19. An electrical connector according to claim 18, comprising a tab extending from the other sidewall toward said one sidewall to overlie said member.

20. An insulation-opening contact for electrical connection to an insulated conductor, comprising:

a thin sheet metal structure including an active contact element, a termination contact element for receiving an insulated conductor and an intermediate contact element connecting said active and termination elements, said termination contact element comprising an elongate U-shaped channel including a pair of spaced sidewalls having inner surfaces, an inwardly directed detent in each of said sidewalls defining a constriction in said channel with respect to the longitudinal axis of the conductor which defines a conductor receiving notch, each of said detents comprising a pair of inwardly directed and connected surface portions of said inner surface, the connection thereof defining a conductor wiping surface portion and another inwardly directed inner surface portion extending at an angle to said pair of surface portions and defining a smooth inner surface portion adjacent and above said wiping surface portion at the entrance of the notch and defining a smoothly rounded blunt nose configuration as a transition between said inner surface and wiping surface portions.

21. An insulation-opening contact according to claim 20, wherein said intermediate contact element comprises a member projecting normal from one of said sidewalls and extending to the other sidewall, said member carrying said active contact element.

22. An insulation-opening contact according to claim 21, comprising a locking tab projecting normal from the other sidewall to overlie said member.

23. An insulation-piercing contact for electrical connection to an insulated stranded conductor, comprising:

a two-surface sheet metal structure including a channel for receiving the insulated conductor in a direction transverse to its longitudinal axis; and notch means in said channel defining a constriction with respect to conductor insertion at least in a direction transverse to the insulated conductor, said notch means carrying said surfaces, and one of said surfaces defining a first zone on said one surface extending generally in the direction of conductor insertion for wiping contact with the conductor, a smooth second zone on said one surface oblique to said first zone to slidably engage the insulated conductor, and a third zone on said one surface comprising a smoothly rounded blunt nose configuration connecting said first and second zones and defining a change in direction and effective to expose the conductor as the insulated conductor travels from said second zone to said first zone, said smooth second zone preventing snagging of the conductor strands.

24. In an insulation-opening contact constructed of sheet metal material of the type wherein an insulated conductor is pressed into a notch which opens the insulation and provides a wiping contact surface portion for the conductor, the improvement comprising:

surface means on the sheet metal material defining a smooth surface portion at the notch entrance oblique to the wiping contact surface portion and a change of direction from the smooth surface portion to the wiping contact surface portion comprising a smoothly rounded blunt transitional configuration to permit non-snagging insertion of an electrical conductor of an insulated stranded conductor.

25. An insulation-opening contact for electrical connection to an insulated conductor, comprising a termination contact element including a U-shaped channel for receiving an insulated conductor therein, said channel including inner surfaces, at least one pair of cup-shaped elements, each of said cup-shaped elements welded to a respective channel inner surface to form a channel constriction and including a plurality of surface portions, each of said surface portions directed inwardly of said channel, a first of said surface portions constituting a conductor opening portion a second of said surface portions constituting a smooth entrance to said constriction and a third of said surface portions constituting a conductor wiping surface.

26. An electrical connector unit for stranded conductors comprising:

a dielectric contact mount including a plurality of U-shaped contact passages each having a box-shaped portion; and a plurality of thin sheet metal electrical contacts, each of said contacts including an active contact element, a termination contact element disposed in a respective U-shaped contact passage to receive an insulated stranded conductor, and a box-shaped intermediate contact element disposed in the respective box-shaped portion and connecting said active and termination contact elements, each of said termination elements comprising an insulation-opening notch including a conductor wiping surface portion of the sheet metal and a smoothly rounded blunt nose notch entrance transition surface portion of the sheet metal extending oblique to and continuous with the wiping surface portion to prevent snagging of exposed strands upon openings of the insulation.

27. An insulation-opening contact for electrical connection to an insulated conductor, said contact formed from a piece of sheet metal material and comprising:

an elongate bottom wall;

a pair of sidewalls extending from said bottom wall at 90° to form an elongate conductor-receiving channel;

at least one detent in at least one of said sidewalls disposed inwardly of said channel so that one of said surfaces of the sheet metal material defines an outwardly opening insulation-opening notch, said detent including a conductor wiping surface portion of the one surface extending in the direction of conductor insertion and a smooth guiding surface portion of the one surface oblique to and developing into said wiping surface portion via a smoothly rounded blunt nose transitional region; and an active element extending from said channel for engagement with the mating contact.

28. The contact of claim 27, comprising a pair of said detents defining said notch.

29. The contact of claim 27, comprising a member extending from one of said side walls at 90° to the other side wall froming a box-shaped element connecting said channel and said active element.

30. The contact of claim 29, wherein said member includes a recess therein, and comprising a locking tab extending at 90° from the other side wall to overlie said member in said recess so that the outer surfaces of said member and said tab are substantially co-planar.

31. The contact of claim 29, comprising an end member extending from one of said side walls at 90° to the other side wall and at 90° to said bottom wall to close off an end of the box-shaped element.

32. The contact of claim 27, wherein each of said detents comprises first and second convergently directed wall sections carrying the one surface and joined to form said wiping surface portion and a third wall section carrying the one surface including said smooth guiding surface portion and joined to said first and second wall sections.

33. The contact of claim 32, wherein the surface portion of said detent within said channel are continuous with the inner surface of the associated side wall.

34. In a metallic contact terminal element constructed of sheet metal material having two surfaces; an insulation-piercing portion for receiving an insulated metallic conductor when inserted in a direction generally normal to its longitudinal axis at the point of insertion and providing electrical engagement with the metallic conductor, the insulation-piercing portion comprising:

notch means carrying one of said surfaces and defining a constriction having an interference relationship with the insulation of the insulated conductor, the notch means defining conductor guiding, insulation-opening and conductor wiping zones on said one surface and including a conductor wiping surface portion extending generally in the direction of conductor insertion; and a conductor guiding surface portion extending oblique to and leading towards the wiping surface portion, and a smoothly rounded blunt nose insulation opening surface portion connecting and defining a change of direction between said guiding and wiping surface portions, said guiding surface portion including a smooth surface zone immediately above and adjacent said insulation-opening portion.

35. In the metallic contact terminal of claim 34, the insulation-piercing portion being formed from thin conductive sheet metal having a smooth major side, said sheet metal being bent to form said guiding surface and said smooth guiding zone from said smooth major side.

36. In the terminal element of claim 34, the insulation-piercing portion including first support means for supporting said guiding surface portion against insertion forces in the direction of insertion.

37. In the terminal element of claim 36, the insulation-piercing portion including second support means for supporting said wiping surface portion against insertion forces in a direction transverse to the direction of insertion.

38. In the metallic contact terminal of claim 36, wherein said first support means includes a wall of the sheet metal material supporting said conductor guiding and wiping surfaces.

39. An insulation-piercing contact for electrical connection to an insulated conductor, comprising:

an open channel for receiving an insulated conductor normal to its axis and including a bottom wall and a pair of spaced side walls extending generally parallel to each other from said bottom wall; and at least one pair of interior walls extending inwardly of said channel from respective ones of said side walls, each of said interior walls comprising an oblique surface directed away from the respective side wall and toward said bottom wall, a conductor wiping portion extending generally in the direction of conductor insertion, an insulation opening portion joining said oblique and wiping surfaces and defining a direction change therebetween, a smooth portion on said oblique surface immediately adjacent said insulation opening portion, and an inwardly bent portion of the respective side walls, said inwardly bent portion including an edge defining said wiping portion and a folded portion folded back over said inwardly bent portion with the fold thereof defining said oblique surface.

40. A thin sheet metal insulation-opening contact for electrical connection to an insulated conductor, comprising:

a termination contact element including a U-shaped channel for receiving an insulated conductor therein, said channel including a pair of facing walls bearing as an inner surface one of the surfaces of the sheet metal; and at least one pair of cup-shaped elements, each of said cup-shaped elements integrally formed in and directed into said channel as inwardly directed portions of respective channel walls to form a channel constriction and including a plurality of surface portions of said inner surface, each of said surface portions directed inwardly of said channel, a first of said portions constituting an insulation-opening portion, a second of said surface portions constituting a smoothly rounded blunt nose transitional surface entrance to said constriction and developing into a third of said surface portions constituting a conductor wiping surface portion.

41. In an insulation-opening section of an electrical contact which is formed from thin sheet metal having a pair of opposite surfaces and which has an insulation-opening notch having a notch entrance, for receiving, opening the insulation of and electrically contacting the conductive core of an insulated conductor, the improvement comprising:

a smoothly rounded blunt nose surface portion as an integral portion of one of said surfaces immediately adjacent and leading transitionally into the entrance of the notch, said smoothly rounded blunt nose surface portion slidingly receiving the core of the insulated conductor therealong as the same moves into the notch.

42. An insulation-opening contact comprising:

a thin sheet metal member including a U-shaped channel having channel walls and an inner surface and an outer surface, said thin sheet metal member including a pair of bent portions extending, spaced apart, inwardly from respective channel walls to form an upwardly opening notch for receiving and electrically contacting an insulated conductor, each of said bent portions including a conductor wiping surface portion and a smooth surface portion above and adjacent said wiping surface portion at the entrance of the notch, said wiping surface portion and said smooth surface portion being portions of the same one of said channel surfaces, and a smoothly rounded blunt nose transition region connecting said wiping surface portion and said smooth surface portion.

43. An insulation rupturing wire termination contact element for establishing and maintaining electrical contact with the conductive core of an insulated wire as the insulated wire is forced into the contact element, comprising a wire termination channel portion having side panels and a base portion of thin conductive sheet metal, at least one of said side panels having an integral offset portion formed inwardly into said channel to engage the conductive core of a wire inserted therein, said offset portion having an end exposed toward the open side of said channel which end is formed by bending said sheet metal into a smoothly rounded blunt transitional configuration having sufficient rigidity for rupturing the insulation of a wire forced into said wire termination channel and for guiding the conductive core of such a wire into contact with the inwardly disposed surface of said offset portion.

44. The wire termination contact of claim 43 wherein said offset comprises a deformation of said side panel defining a ridge extending substantially perpendicular to said base portion.

45. The wire termination contact of claim 44 wherein said ridge is freed from said side panel at its extremity proximate said base portion to allow deformation of said offset portion independent of said base portion.

46. A multi-contact electrical connector for solderless termination of insulation covered electrical conductors comprising: an insulator housing having a mating end, a wire termination end and a plurality of elongated passages extending between said ends; a contact element within each of said channels; each of said contact elements being of thin sheet metal construction and including a mating portion and a wire termination portion, said wire termination portion comprising a pair of side wall sections having an integral offset formed inwardly into said channel to provide a contact jaw and a rounded transitional portion adjacent the free edge of said side wall section for rupturing the insulation and guiding the conductor into contact with said jaw during insertion, said rounded portion being forced by bending said thin sheet metal into a rounded blunt nose sufficiently rigid to rupture and separate the insulation from the conductor.

47. An electrical contact member of thin conductive sheet metal for solderless electrical connection with an insulation covered electrical conductor, comprising: an elongated channel portion with opposite side walls having at least one integral inwardly formed ridge portion extending vertically along at least one of said side walls and defining with a portion of the opposite side wall an upwardly open space for receiving said conductor, the upper portion of each such ridge being of a gradually increasing depth and defining a rounded blunt nose having a continuous thin sheet metal surface for separating the insulation from the conductor and guiding the conductor into said space, the lower portion of each such ridge being substantially parallel to the side walls to define a contact wiping surface for engaging said conductor in electrical contact with said element.

48. An electrical contact member as in claim 47 wherein the lower portion of each such ridge portion comprises a pair of wall sections each of which is integrally joined to the adjacent side wall along one vertical edge, said wall sections being joined together by a curved portion which provides said contact wiping surface, and wherein the upper portion of each of said ridges extends from said wall sections and curved portion and gradually recedes toward the respective side wall in a smooth continuous curve so as to provide a rounded lead-in portion for guiding a conductor into said space.

49. An insulation rupturing wire termination contact element for establishing and maintaining electrical contact with the conductive core of an insulated wire as the insulated wire is forced into the contact element, comprising a wire termination channel portion having side panels and a base portion of thin conductive sheet metal, each of said side panels having an integral offset portion formed inwardly into said channel to engage the conductive core of a wire inserted therein, said offset portions each having an end exposed toward the open side of said channel which end is formed by bending said sheet metal into a smoothly rounded blunt transitional configuration having sufficient rigidity for rupturing the insulation of a wire forced into said wire termination channel and for guiding the conductive core of such a wire into contact with the inwardly disposed surfaces of said offset portions, said offset portions being located in opposing relation to one another and defining a narrowed passageway for receiving a wire forced therebetween.

50. The wire termination contact of claim 49 wherein said offset portions each define contact faces extending substantially perpendicular to said base portion and wherein said side panels have slots transverse to said contact faces to separate the extremity of said contact faces proximate said base portion from said side panels.

51. The wire termination of claim 49 wherein said offset portion of each of said offsets slopes into said channel from adjacent the free edge of the respective side panel to provide a gradually narrowing lead-in for guiding wires inserted into said channel.

52. A termination system for establishing and maintaining electrical contact with an insulation covered electrical conductor, said system comprising first and second sidewall members of thin, conductive sheet metal, means holding said sidewall members in spaced parallel relationship to define a cavity having at least one side open to receive a conductor inserted therein, at least one of sidewall members having an integral portion thereof extending into said cavity to make electrical contact with a conductor inserted into said cavity, said extending portion having (a) a smooth, curved and continuous sheet metal surface extending downward from said sidewall into said channel to define a tapered lead-in surface for guiding the conductor into the cavity and (b) a rounded and continuous sheet metal surface bent to define a substantially rigid blunt nose near said open side of the cavity adjacent said lead-in surface for rupturing and separating the insulation from a conductor as the conductor is inserted into the cavity.

* * * * *